US006381879B1

(12) United States Patent
Bollich

(10) Patent No.: US 6,381,879 B1
(45) Date of Patent: May 7, 2002

(54) AGRICULTURAL DITCHING METHOD AND APPARATUS

(76) Inventor: Gerald Bollich, 1360 Drew Ave., Eunice, LA (US) 70535

( * ) Notice: Subject to any disclaimer, the term of this patent is extended or adjusted under 35 U.S.C. 154(b) by 0 days.

(21) Appl. No.: 09/520,409

(22) Filed: Mar. 8, 2000

(51) Int. Cl.[7] ..... E02F 5/08

(52) U.S. Cl. ..... 37/91; 37/365; 172/79; 172/145; 172/175; 172/684.5

(58) Field of Search ..... 37/347, 189, 365, 37/378, 372; 172/79, 80, 63, 51, 64, 70, 71, 108, 134, 138, 139, 145, 175, 177, 197, 817, 833, 300, 297, 387, 540, 604, 684.5

(56) References Cited

U.S. PATENT DOCUMENTS 816,543 A * 3/1906 Erb et al.
2,164,543 A * 7/1939 Peacock
2,204,569 A * 6/1940 Bushong
2,218,948 A * 10/1940 Cooper
2,259,874 A * 10/1941 Benjamin
2,329,794 A * 9/1943 Speck
2,505,280 A * 4/1950 Ellinghuysen
2,691,333 A * 10/1954 Shumaker
3,760,885 A * 9/1973 McKenzie
4,620,381 A * 11/1986 Plyler et al.
4,687,065 A * 8/1987 Cope et al.
4,896,443 A * 1/1990 Klinger et al.
5,113,610 A 5/1992 Liebrecht, Jr.
5,203,100 A 4/1993 Snyder et al.
5,237,761 A * 8/1993 Nadeau et al.
5,511,326 A 4/1996 Liebrecht, Jr.
5,875,573 A 3/1999 Hayden
6,102,130 A * 8/2000 Heckendorf

* cited by examiner

*Primary Examiner*—H. Shackelford
(74) *Attorney, Agent, or Firm*—Robert N. Montgomery

(57) ABSTRACT

A method and apparatus for forming a relatively shallow drainage ditch diagonally across crop rows, the apparatus, drawn or fitted to a tractor, incorporates a rotating cutting disk set semi-vertical and at obtuse angles to the direction of travel. The disk is adjustable in two planes and is driven either by direct drive from the tractor's PTO or by hydraulic motor. The replaceable disk is fitted with slinger plates to insure proper removal of the excavated earth. An adjustable cutting tooth is provided in front of the disk for breaking the soil prior to being cut by the rotating disk. A trailing wheel or foot skid, in conjunction with a flexible upper connection of the three point hitch, is provided to control the cutting depth of the tooth and cutting disk, thereby allowing the tooth and cutting disk to follow the contour of the earth. The apparatus is also mountable to the front of a tractor, if desired, when the disk is driven hydraulically. The breaker tooth may also be mounted independently to the front of the tractor for breaking levees prior to ditching, thereby allowing tractor egress.

13 Claims, 11 Drawing Sheets

AGRICULTURAL DITCHING METHOD AND APPARATUS

BACKGROUND OF THE INVENTION

1. Field of the Invention

This invention relates generally to earth moving equipment and more particularly to ditchers for cutting agricultural drainage ditches diagonally across crop rows and along head lands . The ditcher is an agricultural type to be towed or fitted in a three-point hitch arrangement and operated by the power take-off (PTO) and hydraulic system either in the front or rear of a farm tractor.

2. General Background

Agricultural row crops, especially those with deep furrows, often require cross row drainage ditches to insure proper irrigation and drainage. Producing these deep contoured ditches in a manner whereby they will sustain long term service without additional channeling and cleaning operations after the crops are planted has been a difficult problem for many years.

Various apparatus have been employed to perform the ditching operation. Some universal types used for road ditching and cleaning operations, such as that disclosed by Snyder et.al. In U.S. Pat. No. 5,203,100, have been used with some success in agricultural operations. However, such side mount or rear mounted and side operated apparatus are generally expensive and are restricted to a much slower speed due to the tangential force applied to the side boom cutting head. Other ditchers which may be drawn behind a tractor or fitted to the tractor's three-point hitch, such as those disclosed by U.S. Pat. Nos. 5,511,326, 5,113,610, 5,875,573, allow a faster pace but are designed for a very large cut and are also expensive due to their complexity.

It is therefore desirable to provide an inexpensive PTO driven three-point hitch attachment with a relatively small disk blade that has the ability to make a deep cut through each row at a rapid pace. Although it is somewhat known in the art that utilizing a relatively small rotating disk set semi-vertically at obtuse angles to the direction of travel will effectively cut such ditches, such apparatus to date have only been used as side mounts in which case the earth being moved is thrown into the air, often engulfing the tractor operator. It is therefore essential that an appropriate ditching apparatus be mounted to the tractor in a manner whereby the earth being excavated is controlled and strategically placed.

SUMMARY OF THE INVENTION

A method and apparatus for forming a relatively shallow drainage ditch diagonally across crop rows, the apparatus, drawn or fitted to a tractor, incorporates a rotating cutting disk set semi-vertical and at obtuse angles to the direction of travel. The disk is adjustable in two planes and is driven either by direct drive from the tractor's PTO or by hydraulic motor. The replaceable disk is fitted with slinger plates to insure proper removal of the excavated earth. An adjustable cutting tooth is provided in front of the disk for breaking the earth prior to being cut by the rotating disk. A trailing wheel, in conjunction with a flexible upper connection of the three point hitch, is provided to control the cutting depth of the tooth and cutting disk, thereby allowing the tooth and cutting disk to follow the contour of the earth. The apparatus is mountable to the front of a tractor, if desired, when the disk is driven hydraulically. The breaker tooth may also be mounted independently to the front of the tractor for breaking levees 99 prior to ditching, thereby allowing tractor egress.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
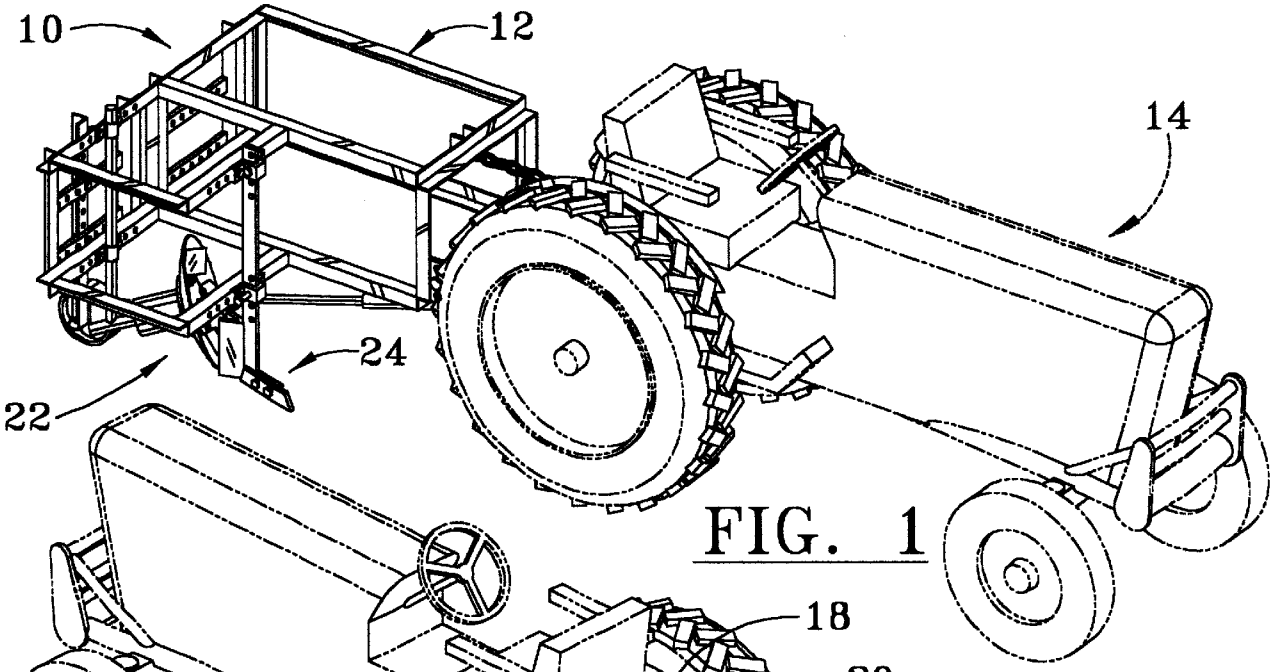
FIG. 1 is an isometric side elevation view of a first embodiment attached to a tractor.
Figure 2:
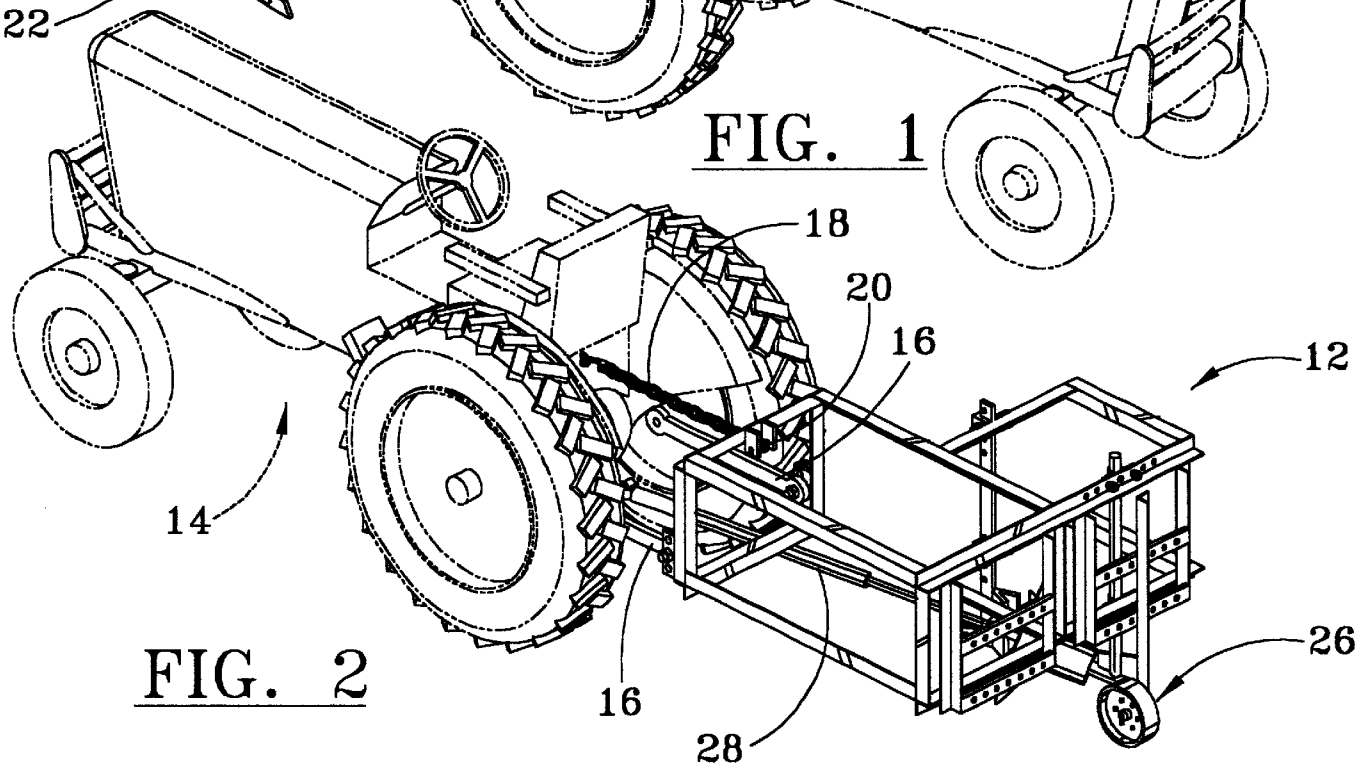
FIG. 2 is an isometric rear elevation view of the first embodiment attached to a tractor.

As seen in FIG. 1, the first or alternate embodiment of the ditching implement 10 consists of a structural, L-shaped framework 12 extending rearwardly from the tractor 14. As seen in FIG. 2, the framework 12 is pivotally mounted to the lower three-point hitch lifting arms 16 and flexibly attached with a chain 18 at the upper connection point 20, thereby allowing the framework to be raised or lowered for turning and transporting. However, the framework could just as easily be adapted with a set of front wheels and made towable.

The frame work 12 provides location and support for the rotating disk assembly 22, the breaker tooth assembly 24 seen in FIG. 1, and the depth gauge wheel assembly 24 seen in FIG. 2.

The rotatable disk assembly 22 may be driven directly by the telescopic drive shaft 28, best seen in FIG. 2, connected to the tractor's PTO drive unit. However, the disk may also be driven hydraulically by means of a hydraulic motor attachment to be discussed later.

Figure 3:
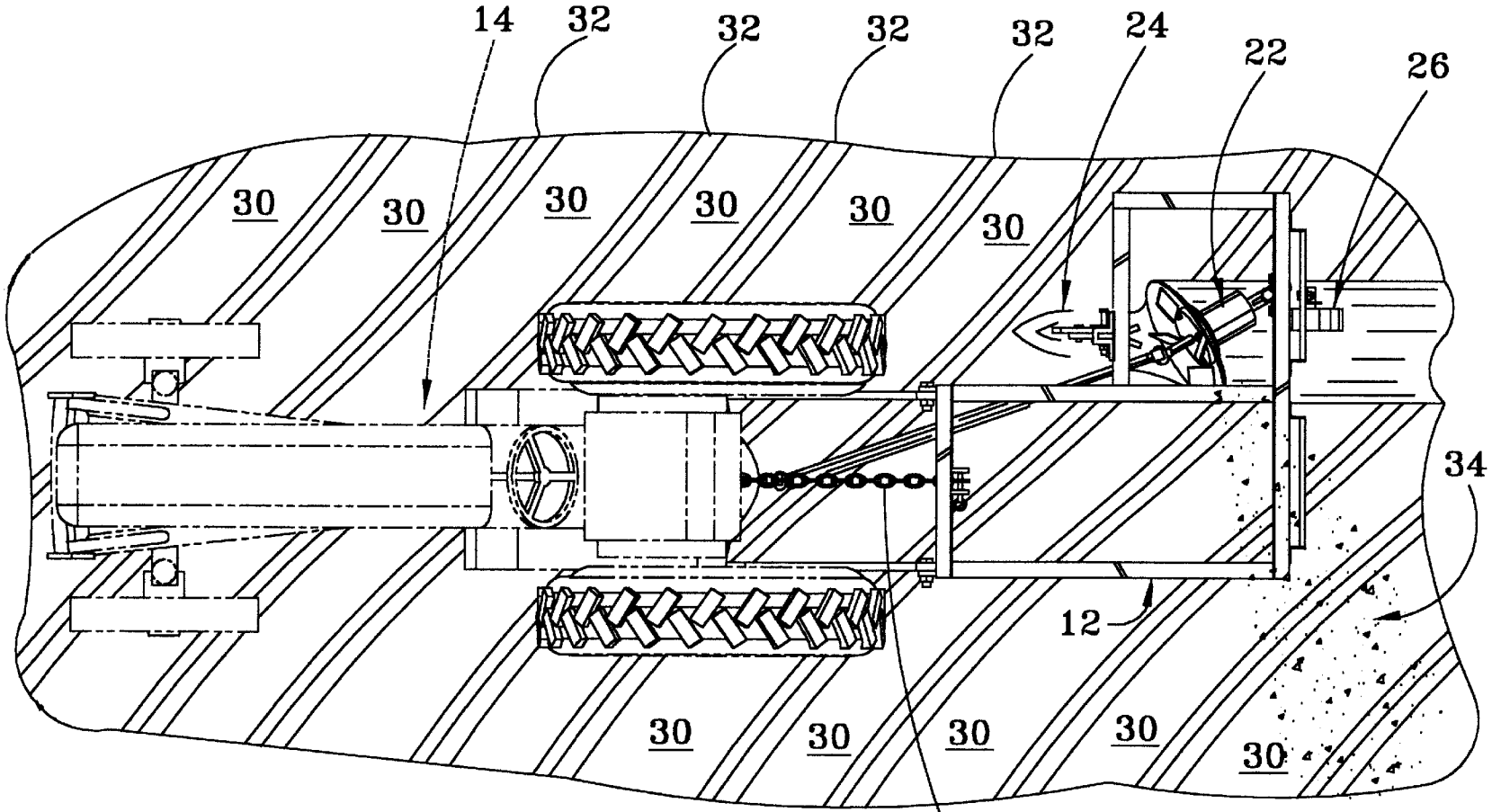
FIG. 3 is a top view of the first embodiment in operation and attached to a tractor.

As seen in plan in FIG. 3, the tractor 14 moves across the rows 30 and the furrows 32 at obtuse angles. The ditcher's frame work 12 positions the cupped cutter disk assembly 22 semi-vertically or approximately 15 degrees off the vertical central axis and at an obtuse angle of approximately 45 degrees to the direction of travel and approximately inline with the rear tractor tire. The breaker tooth assembly 24 is located immediately in front of the rotating disk and thus breaks the ground compressed by the tractor's tires. The depth gauge wheel assembly 26 maintains the disk and breaker tooth at a preselected depth, thus controlling their penetration. Any rise in the earth contour allow the frame to move upwards due the flexible chain connection. The disk tooth and wheel assemblies are all adjustable relative to the frame assembly to compensate for tractor wheel spacing and row height.

Figure 5:
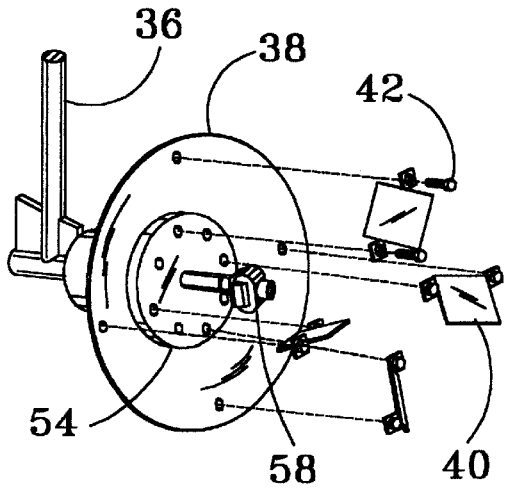
FIG. 5 is a partial exploded view of the removable components connected to the rotatable disk illustrated in FIG. 4.
Figure 4:
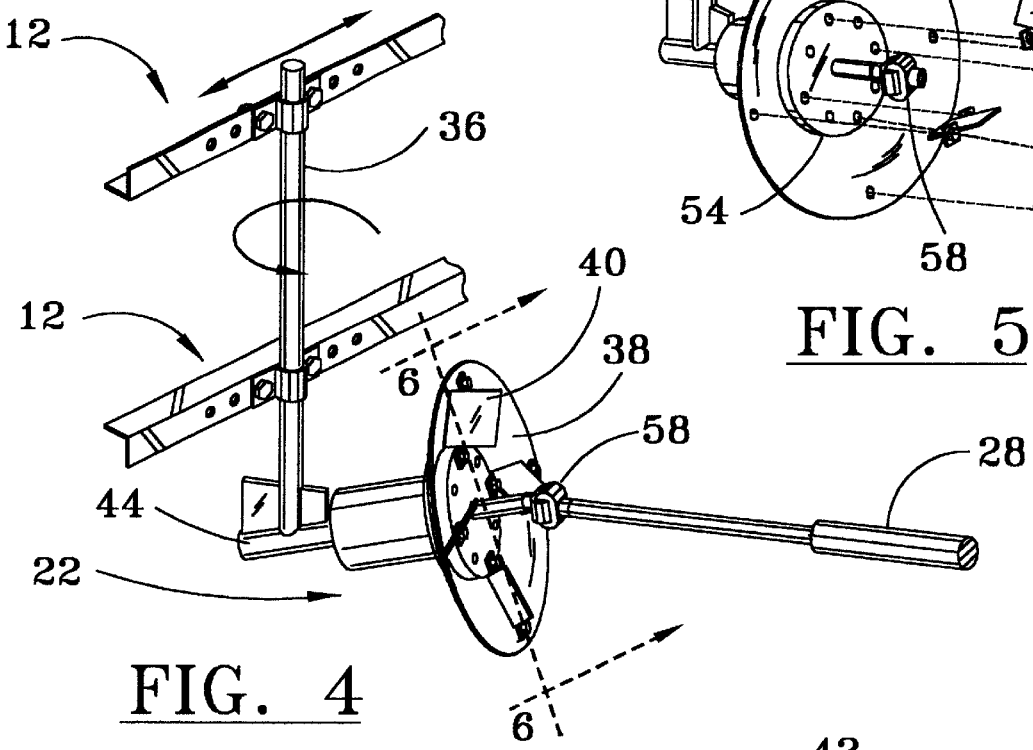
FIG. 4 is partial detailed isometric view of the rotatable disk assembly illustrated in FIG. 1.
Figure 6:
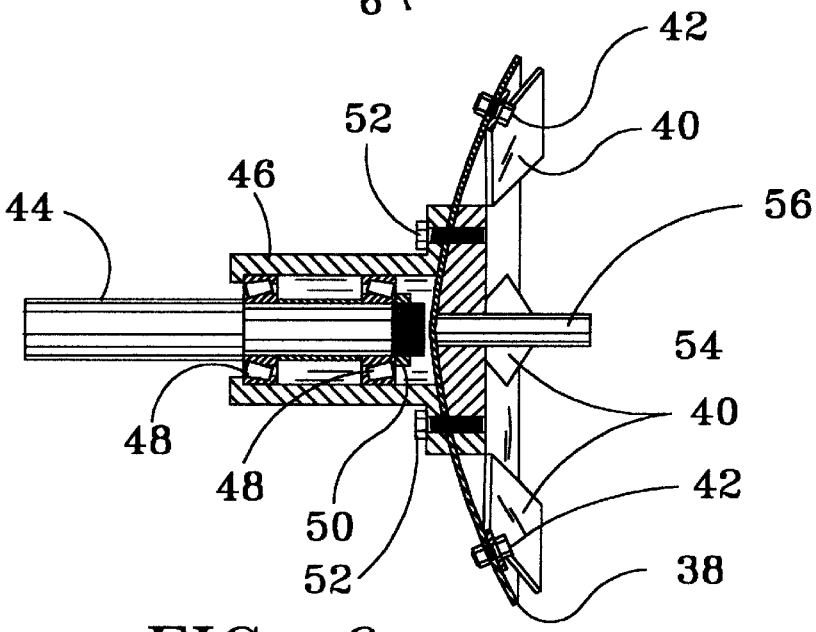
FIG. 6 is a cross section view taken along sight line 6—6 seen in FIG. 4.

It should be noted that earth 34 being excavated by the rotating disk is being deposited over several rows but rearwardly and away from the tractor operator. Turning now to FIG. 4, we see a detail of the rotatable disk assembly 22 supported by a rod 36 held in infinite adjustability and clamped in position to elements of the frame work 12. The rod 36 allows the rotating disk to be pivoted to the optimum attack angle. The attach angle for the cupped disk perpendicular to the earth is generally set at approximately 15 degrees off the vertical axis of the disk and 45 degrees off the direction of travel. The relatively small, replaceable cupped disk 38 is fitted with replaceable slinger plates 40 bolted in place by fasteners as seen in FIG. 5. The slinger plates help remove loose earth from the face of the disk without slinging the earth great distances. The cupped disk 38 is generally less than three feet in diameter, which is considerably smaller than that used by most ditchers utilizing the vertical single disk arrangement. As seen in FIG. 6, the disk assembly 22 includes the stub shaft 44 and a bearing hub 46 that is rotatable about the stub shaft 44 on conical bearings 48 and locked in place relative to the stub shaft 44 by a retainer nut 50. The relatively small cupped disk 38 is attached to the bearing hub by fasteners 52 attached to inner shaft plate 54 which includes a fixed connecting rod 56 and the universal joint 58 seen in FIG. 4. The universal joint is cooperative with telescopic drive shaft 28.

Figure 7:
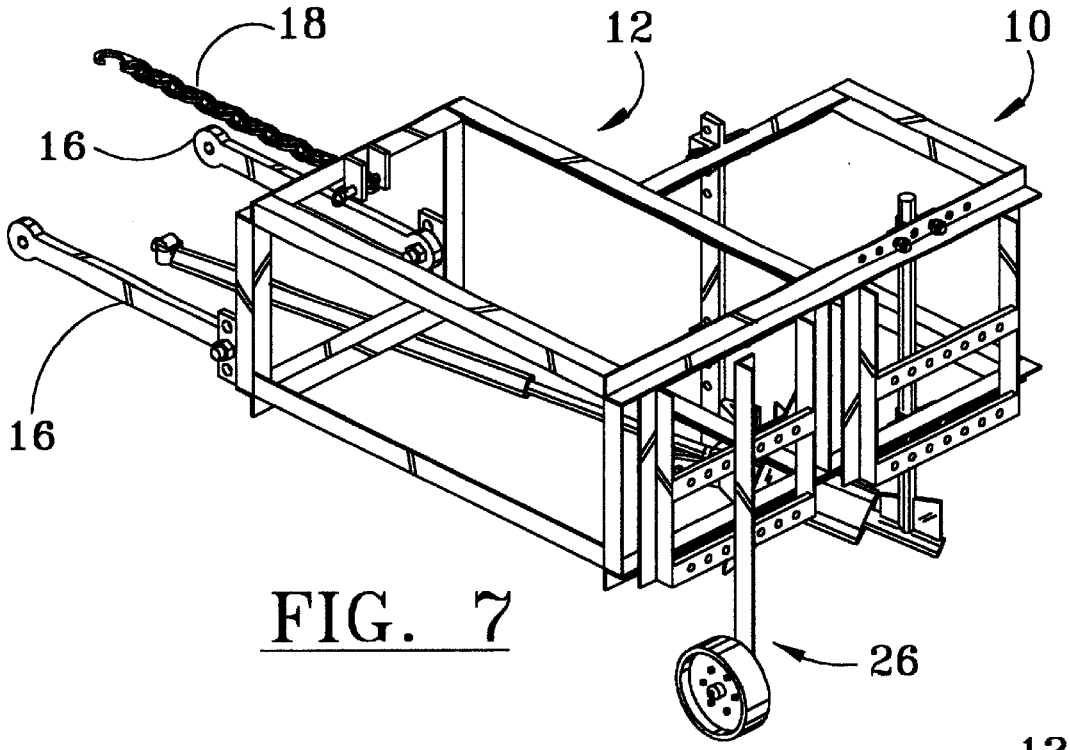
FIG. 7 is a isometric rear elevation view of the first embodiment.
Figure 9:
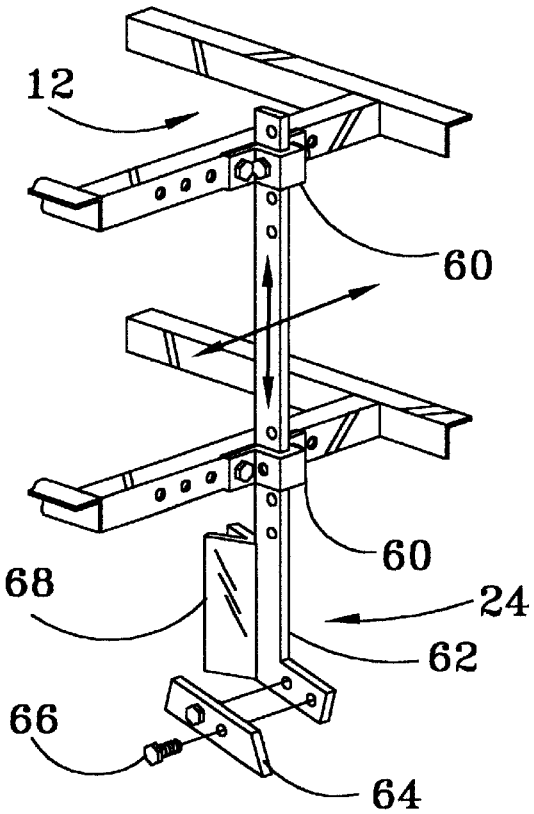
FIG. 9 is a partial detailed frontal elevation view of the breaker tooth.
Figure 8:
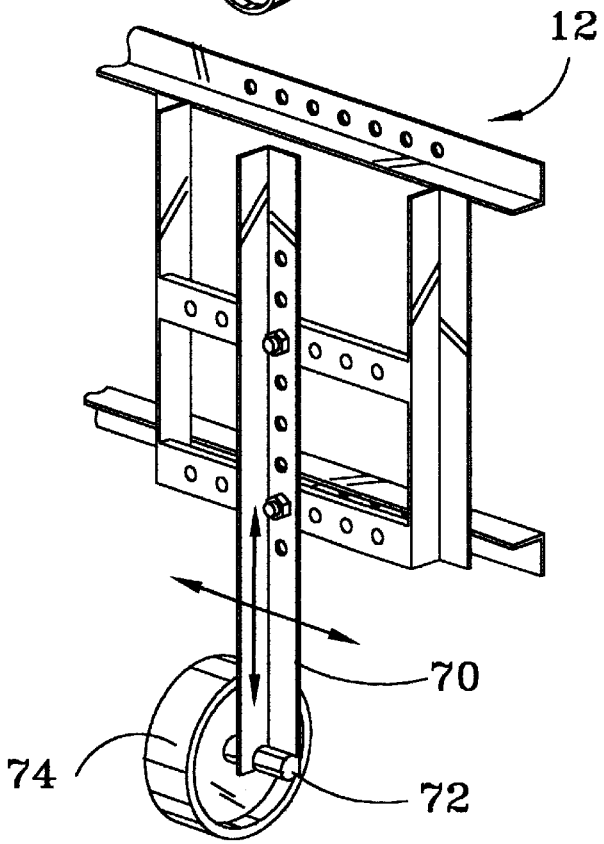
FIG. 8 is a partial rear elevation view of the adjustable depth gauge wheel illustrated in FIG. 7.

Turning now to FIG. 7, we see that the depth gauge wheel assembly may be positioned alternatively behind the tractor wheel opposite the rotatable disk assembly 22, thereby providing greater support to the frame work 12. FIG. 9 illustrates in detail the arrangement of the breaker tooth assembly 24 held in vertical and horizontal adjustment by brackets 60. The breaker tooth includes a vertical bar 62 having a holes therein for adjustment, a removable cutter bar 64 secured to the vertical bar 62 with fasteners 66, and a "V" shaped heel plate which serves to help spread and open a furrow proceeding the rotating disk assembly 22. As seen in FIG. 8, the depth gauge wheel assembly may be adjusted vertically or horizontally and includes a vertical member 70 for attachment to the framework 12, an axial stub and bearing assembly 72, and a wheel 74.

Figure 10:
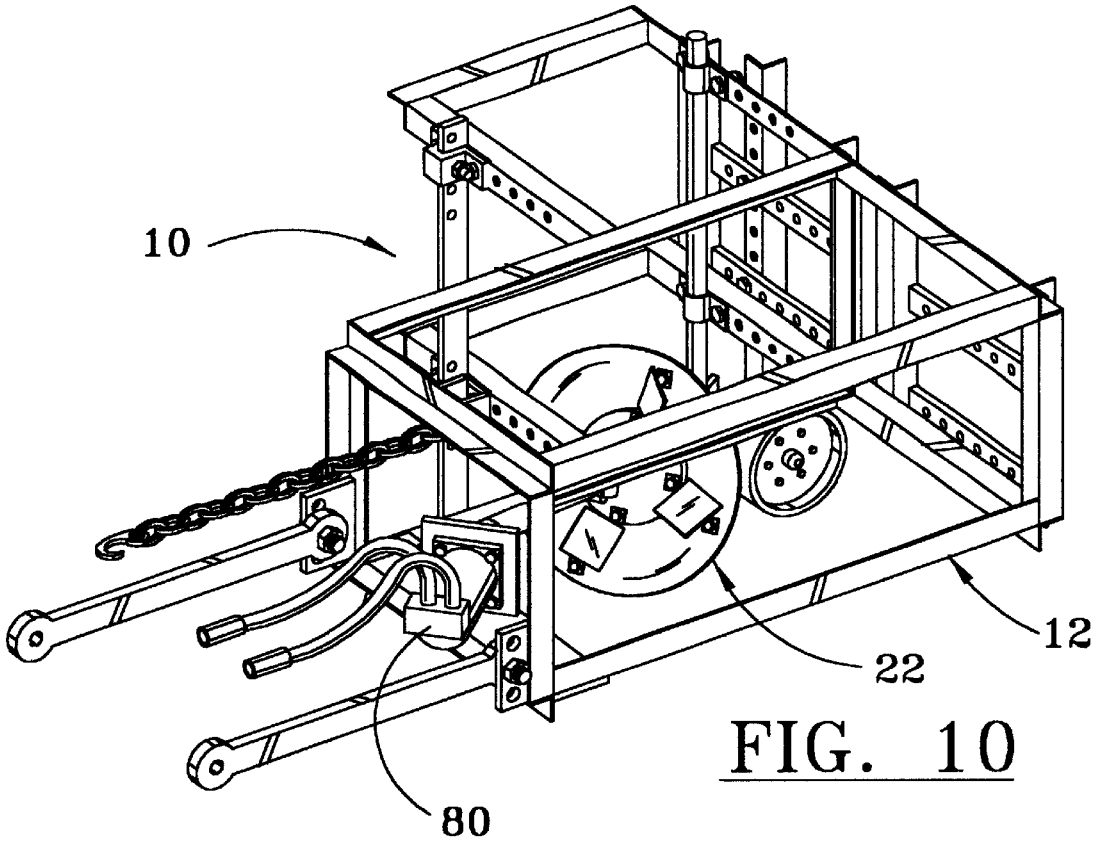
FIG. 10 is an isometric left side elevation view of the first embodiment with hydraulic drive.
Figure 11:
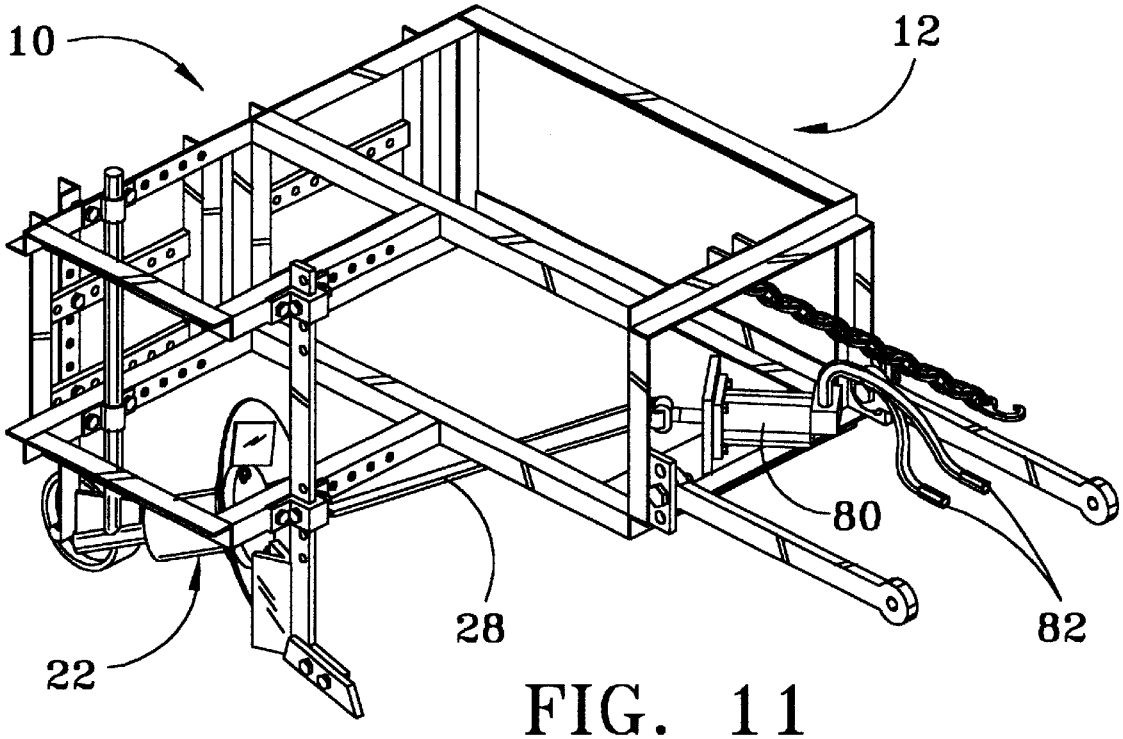
FIG. 11 is an isometric right side elevation view of the first embodiment with hydraulic drive.
Figure 12:
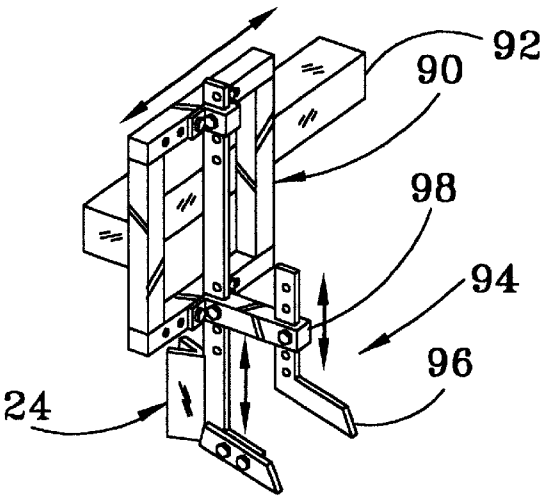
FIG. 12 is a detailed isometric view of a levee breaker tooth attachment.
Figure 13:
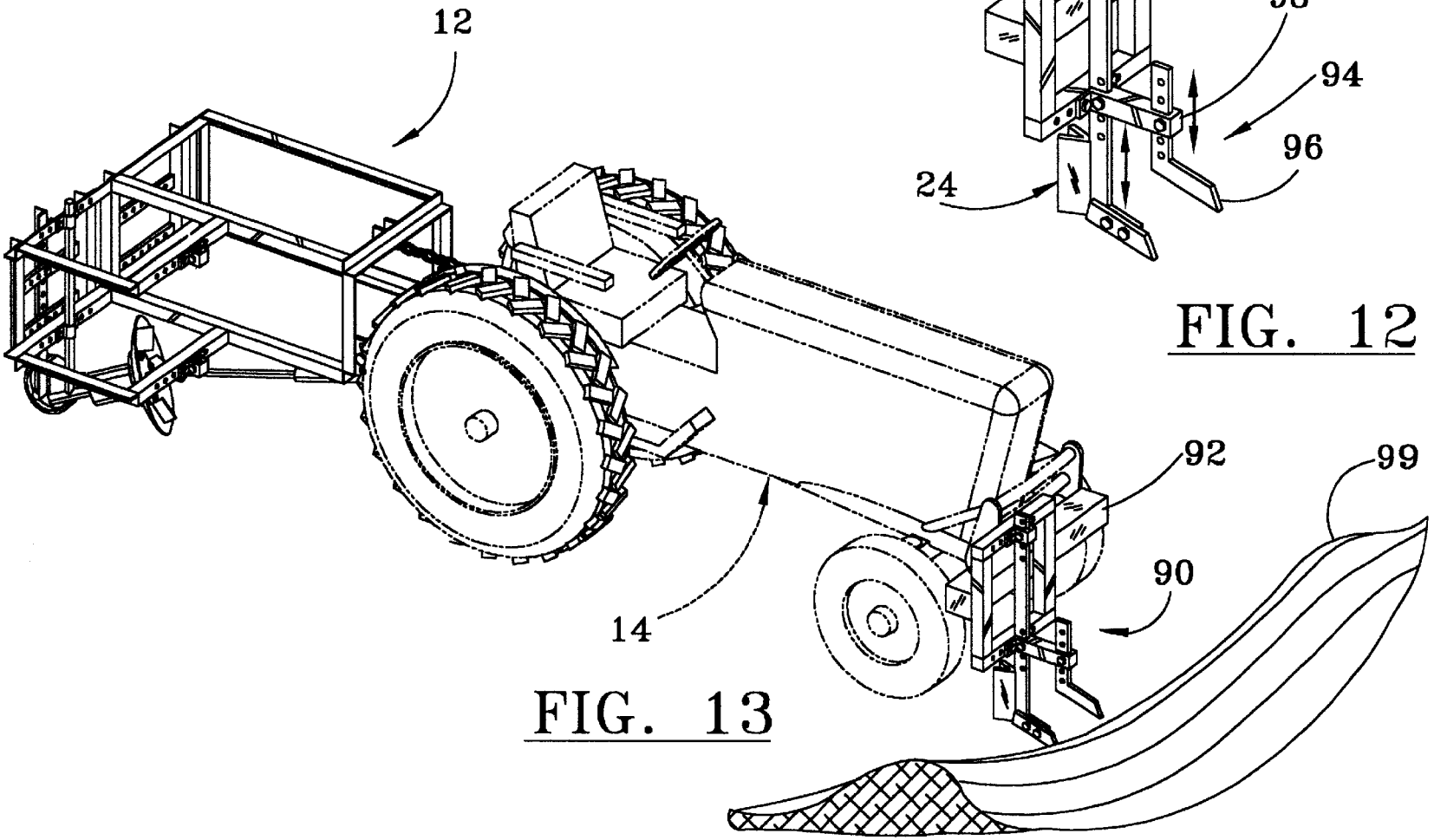
FIG. 13 is an isometric view of the first embodiment with levee breaker attachment.

As mentioned above, the rotating disk assembly 22 may be driven by a hydraulic motor 80, as seen in FIG. 10 and 11, while still retaining the same ditching configuration by simply attaching the drive shaft 28 to a hydraulic motor 80. The motor is then connected via hoses 82 to the tractor's hydraulic pump and control system when present with sufficient capacity to drive the disk. Alternatively, the breaker tooth assembly 24 may be adapted to a frame work 90 having adjustment means and attached to the front bumper 92 of the tractor 14 and may also include a second breaker tooth assembly 94 including a vertical tooth bar 96 having adjustment means and a mounting bracket 98. This arrangement allows the breaker to break high terraces or levees to allow passage of the tractor's wheels thus providing an easier transition of the ditching disk assembly 22, through the terrace or levee.

Figure 14:
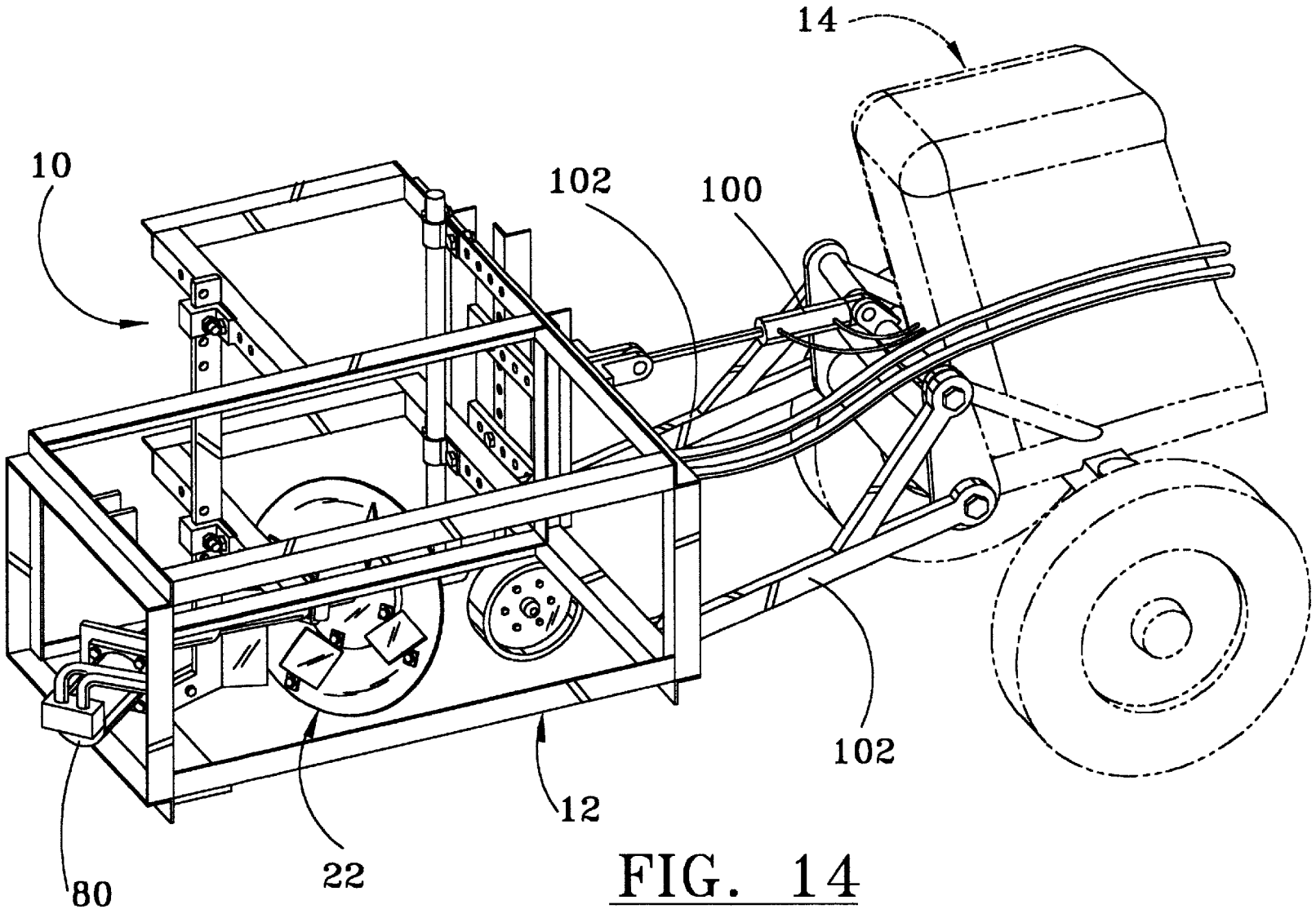
FIG. 14 is an isometric view of the preferred embodiment with hydraulic drive with frontal tractor mounting.

The ditching implement 10 may also be adapted to the front of a tractor, as seen in FIG. 14, and thereby precede the tractor 14. In this arrangement, the ditcher 10 requires that the hydraulic drive option be utilized and that a hydraulically controlled lifting cylinder 100 be provided, along with adapter links 102 for connecting the frame work 12 to the tractor 14.

Figure 15:
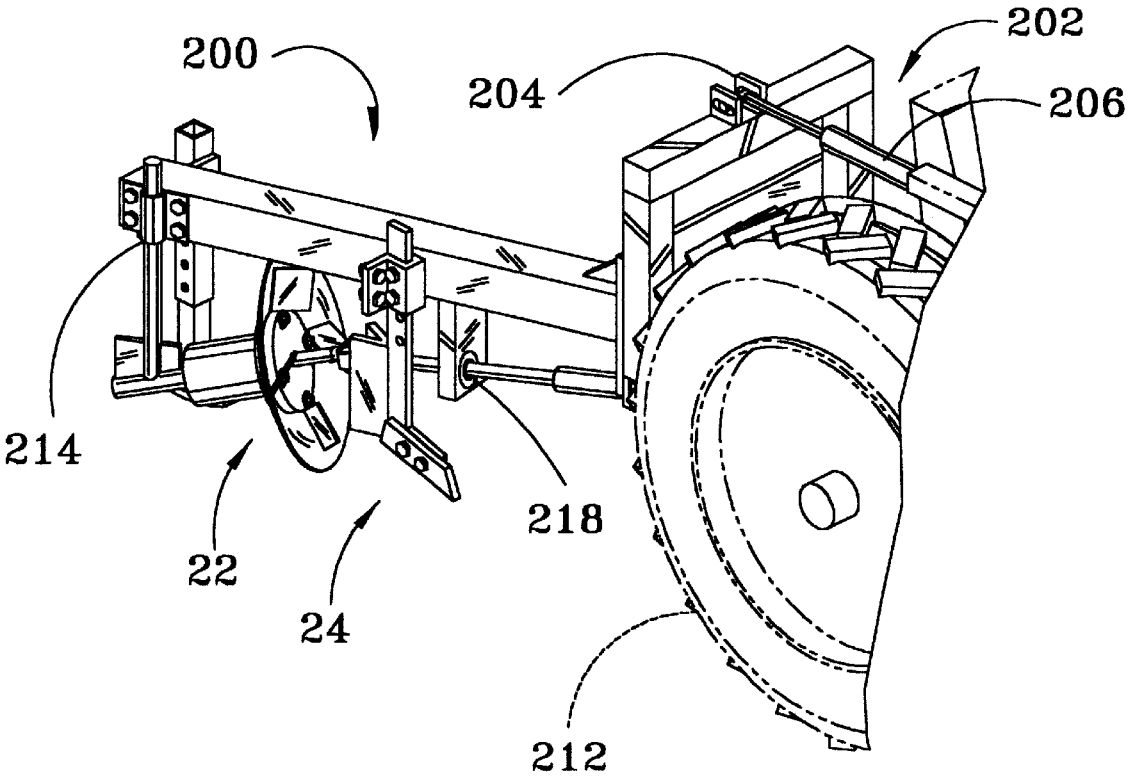
FIG. 15 is a right side isometric view of the preferred embodiment.
Figure 16:
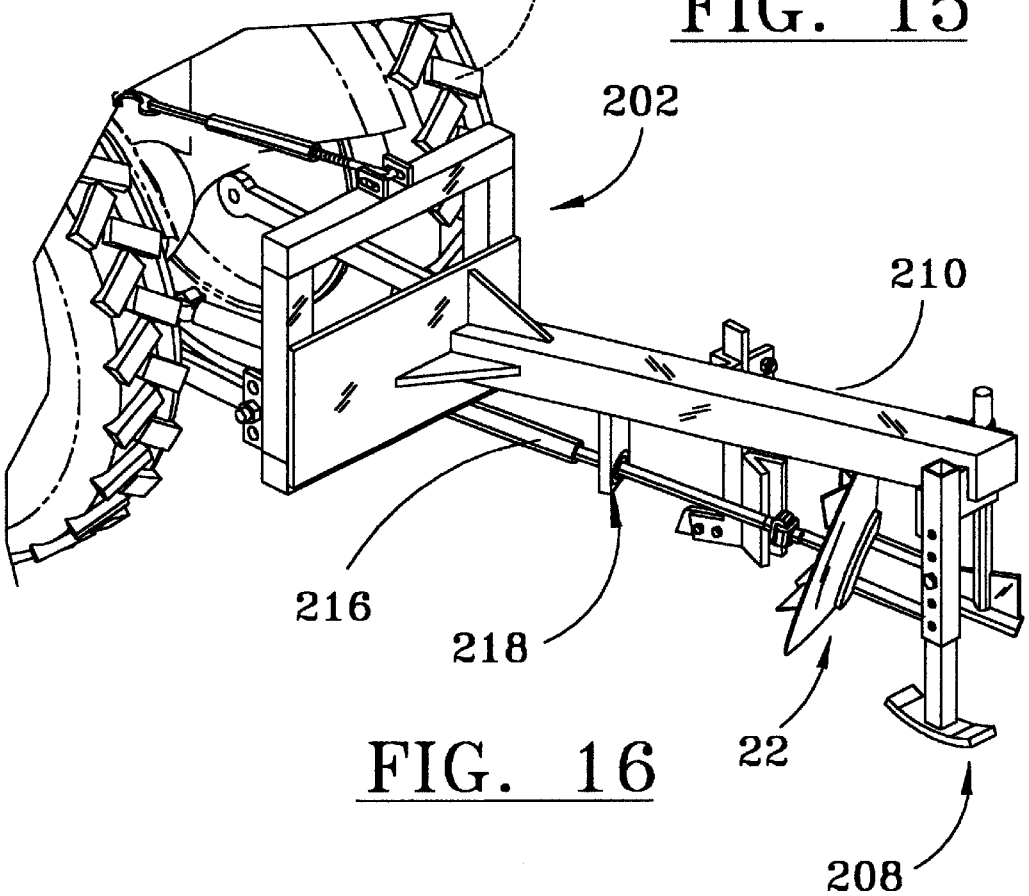
FIG. 16 is a rearward isometric view of the preferred embodiment.

Turning now to FIG. 15, we have the preferred embodiment of the ditching implement 200. This assembly, although not as versatile or adaptable to as many tractor configurations as the first ditcher embodiment 10 seen in FIGS. 1 and 2, is more economical to produce and contains the essential features. The preferred embodiment 200 includes a frame assembly 202 which is adaptable to the standard three-point hitch utilized by most agricultural tractors. The frame 202 is thus elevated and tilted by the three-point hitch, well known with in the art. The exception being that the mounting clevis 204 engaged by the upper, adjustable three point hitch arm 206 is slotted to allow for a certain amount of float as a result of the adjustable foot assembly 208 following the ditcher assembly 22 as seen in FIG. 16. The foot controls the depth penetration of the rotating disk. The embodiment further includes a boom 210 extending laterally from the frame assembly 202 generally positioning the ditcher assembly 22 at an obtuse angle following the tractor wheel 212. As seen in FIG. 15, the ditcher assembly 22 is rotatably mounted in mounting bracket 214 to allow the ditcher 22 to be rotatably positioned to provide the best horizontal angle of attack. The equivalent foot assembly 208 replaces the depth gauge wheel 26 in the first embodiment and is attached to the boom 210 rearwardly of the ditcher assembly 22, adjustable by telescopic positioning to control the ditcher depth. However, the ditcher is also adjustable vertically in the mounting bracket 214 to increase or decrease the vertical angle of attack. The ditcher is driven by a drive shaft 216 extending from the tractor PTO (power takeoff) in a similar manner as illustrated in the first embodiment. However, in some cases a carrier bearing 218 may be necessary to ensure shaft rigidity. As best seen in FIG. 15, the breaker tooth assembly 24 is likewise attached to the boom 210. The breaker tooth assembly is located forwardly of the ditcher assembly 22 and inline with the tractor tire 212 and is adjustable vertically and horizontally.

Figure 17:
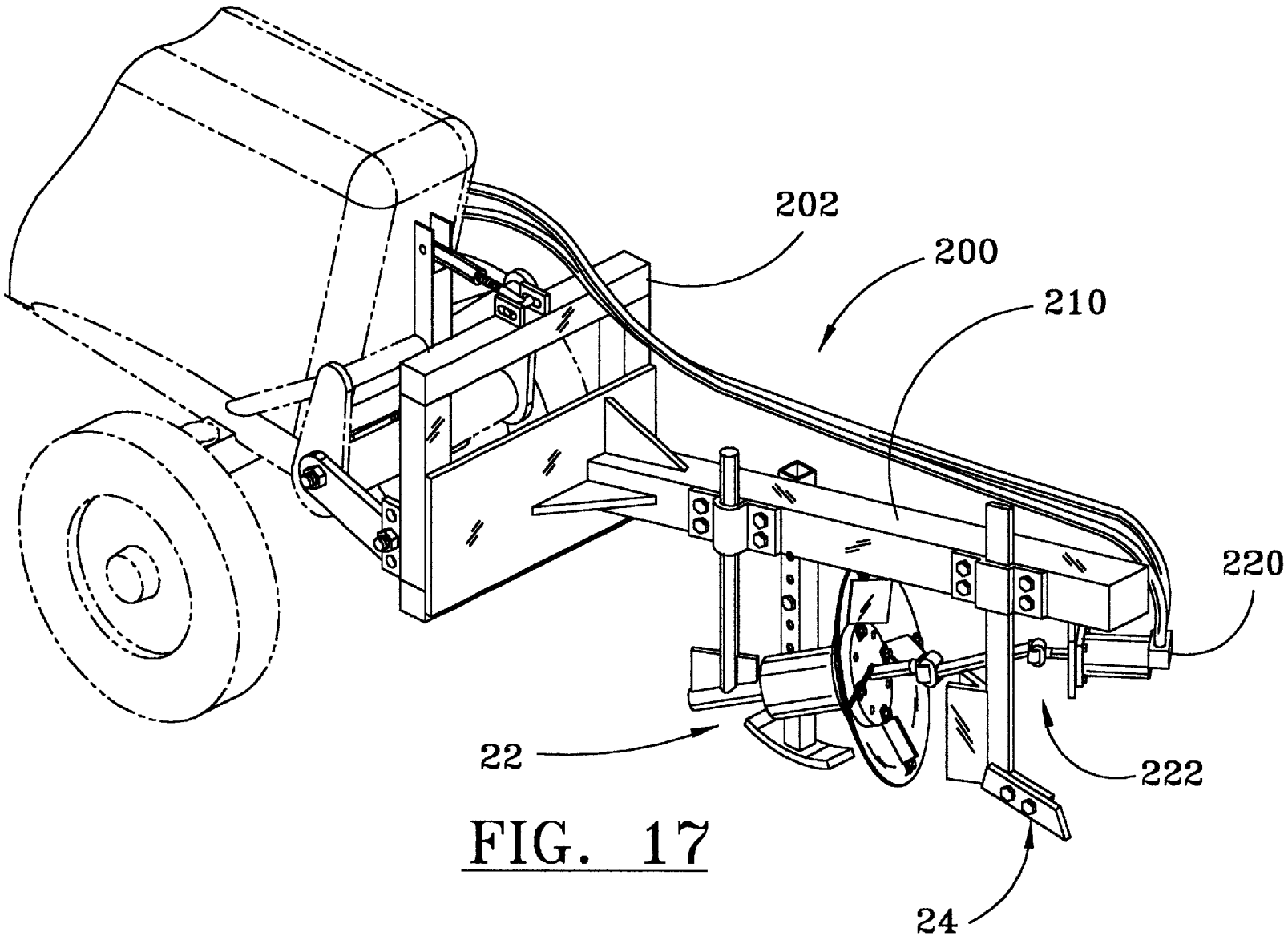
FIG. 17 is an isometric view of a front mounting of the preferred embodiment.
Figure 18:
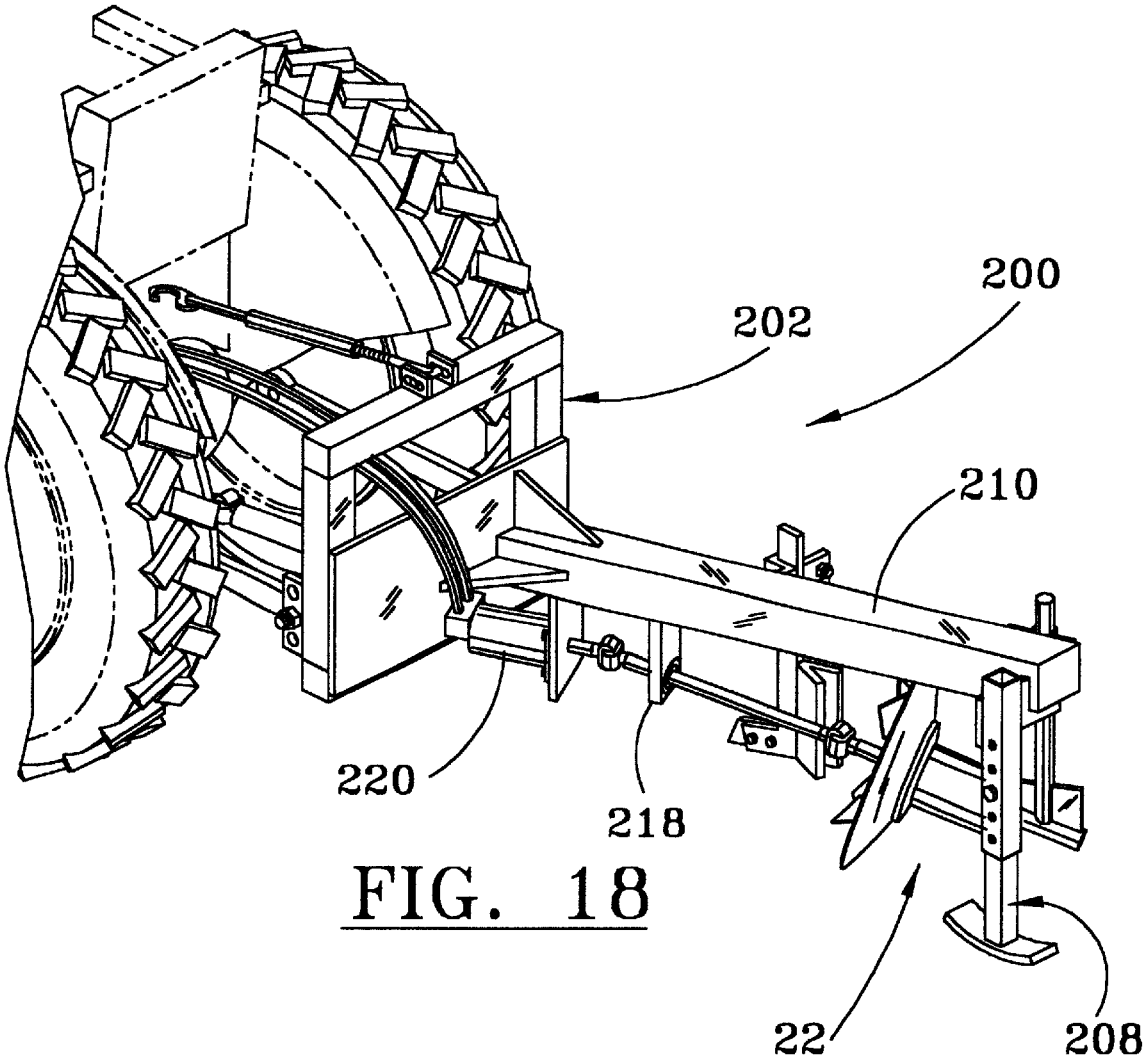
FIG. 18 is a rear isometric view of the preferred embodiment.

The preferred embodiment 200 seen in FIG. 15 may also be mounted to the front of the tractor, as seen in FIG. 17, by equipping a three point hitch arrangement to the front of the tractor in a manner which provides lift and tilt In this arrangement, the frame 202 is attached to the boom 210 rearwardly of the ditcher assembly 22 and breaker tooth 24. The boom is laterally positioned in line with and so as to precede the wheels of the tractor. In this configuration, the ditcher is generally driven hydraulically by a motor 220 attached to the ditching assembly 22 by a double universal joint drive link. The motor may also be made adjustable both horizontal and vertically to allow for continuous alignment with the ditcher assembly. Likewise, the ditcher assembly 22 may be driven hydraulically as seen in FIG. 18 for more precise control of the ditcher speed.

Figure 19:
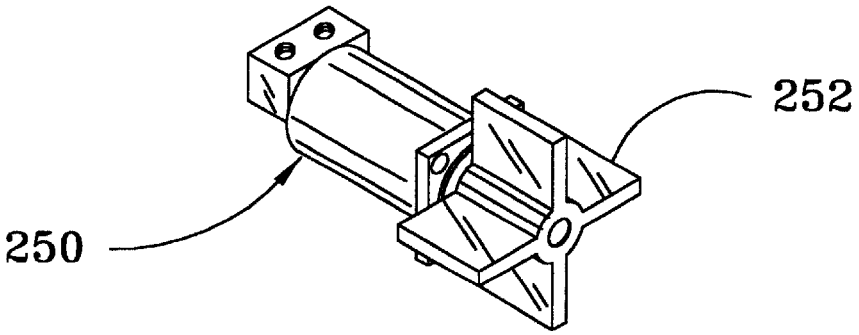
FIG. 19 is an isometric view of the hydraulic dirt slinger.
Figure 20:
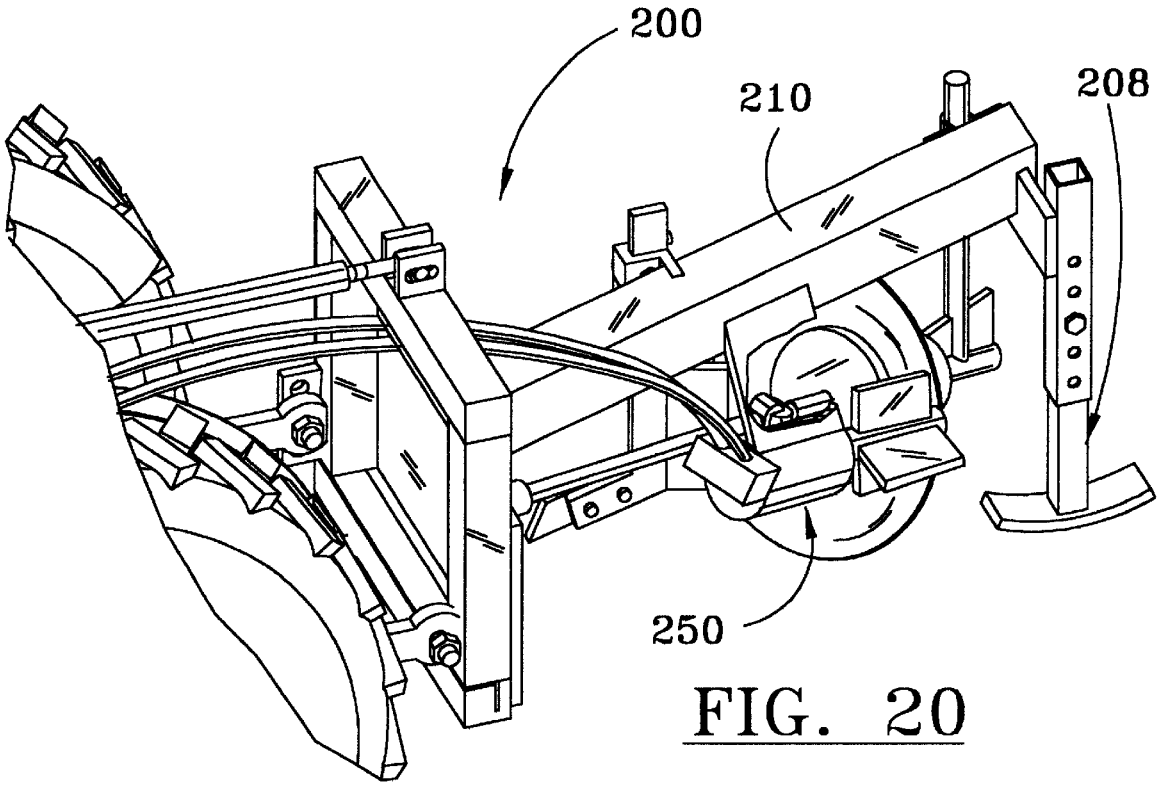
FIG. 20 is an side elevation isometric view of the preferred embodiment with hydraulic dirt slinger.
Figure 21:
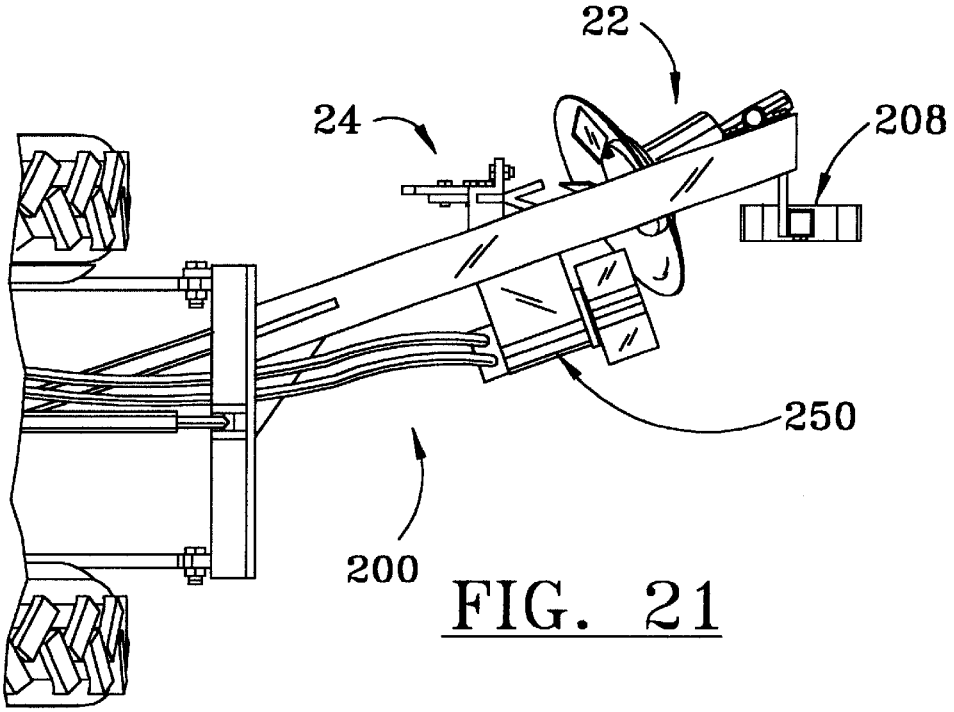
FIG. 21 is a top view of the preferred embodiment illustrated in FIG. 20.

A hydraulic motor drive assembly 250 having a paddle hub member 252, as illustrated in FIG. 19, may be utilized as seen in FIGS. 20 and 21. This configuration positions the paddle hub member 252 perpendicular to the ditcher blade in a manner whereby the paddle hub clears earth from the ditcher's blade and redistributes the earth scoured by the ditching operation some distance from the ditcher. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A ditcher assembly adapted for three point hitch attachment to tractor type vehicles having a power take-off system and moved perpendicularly to rows and furrows in a field to form a drainage ditch, said ditcher comprising:

d) a frame having a three-point hitch connection adaptable to said tractor type vehicles having a power take-off system;

e) a cupped face, rotatable disk assembly centrally driven by said power take-off system, said disk assembly being suspended from said frame, and located at an obtuse vertical angle relative to the earth and at an obtuse angle relative to the direction of travel, said disk assembly adapted to be offset from the central longitudinal axis of said tractor type vehicles; and f) a breaker tooth located forwardly of said disk assembly.

2. The ditcher assembly according to claim 1 wherein said ditcher assembly further comprises a means for adjusting said disk assembly vertically and rotationally in the horizontal plane relative to said frame.

3. The ditcher assembly according to claim 1 wherein said ditcher assembly further comprises a depth control means for limiting penetration of said disk assembly, said depth control means attached to said frame generally inline with said breaker tooth and rearwardly of said disk assembly.

4. The ditcher assembly according to claim 1 wherein said ditcher assembly further comprises a means for adjusting vertical positioning of said breaker tooth relative to said frame and horizontal positioning relative to the central longitudinal axis of said tractor type vehicle.

5. The ditcher assembly according to claim 4 wherein said breaker tooth is adapted to be mounted to the front of said tractor type vehicle and precedes said vehicle.

6. The ditcher assembly according to claim 1 wherein said disk assembly is driven by the power-take-off system of said power mover and is connected by a telescopic drive shaft.

7. The ditcher assembly according to claim 1 wherein said rotatable disk assembly comprises:

a) a vertical support rod adjustably attached to said frame;

b) a stub shaft attached to said vertical support rod at an obtuse angle;

c) a plurality of bearings and seals adapted to said stub shaft and retained thereon;

d) a bearing housing having a bolt flange with an internal bevel rotatably attached to said stub shaft;

c) a convexed inner face plate having a drive shaft attached thereto; and d) a replaceable cupped disk captured between said bearing housing and said inner face plate.

8. The ditcher assembly according to claim 1 wherein said frame comprises a first frame member adapted for connection to a three point hitch arrangement and a second frame member extending outwardly at an obtuse angle from said first frame member.

9. The ditcher assembly according to claim 1 wherein said disk assembly and said breaker tooth are mounted to said second frame member.

10. The ditcher assembly according to claim 8 wherein said depth control means is a vertically adjustable shoe.

11. The ditcher assembly according to claim 3 wherein said depth control means is a pivotal wheel adjustable both horizontally and vertically.

12. The ditcher assembly according to claims 7 wherein said cupped disk further comprises a plurality of slinger plates removably attached to the cupped face of said disk at an obtuse angle relative to said face.

13. A method for forming a uniform drainage ditch with an agricultural implement attached to the three point hitch of a tractor having a power take-off system, the method comprising the steps of:

a) providing an implement comprising:

i) a frame having a three-point hitch connection adaptable to a tractor type vehicle;

ii) a cupped faced, rotatable disk assembly centrally driven by said power take-off system, said rotatable disk being suspended from said frame at an obtuse vertical angle relative to the earth and at an obtuse angle relative to the direction of travel, said disk adapted to be from the central longitudinal axis of said tractor type vehicle; and ii) a breaker tooth located forwardly of said rotatble disk assembly;

b) attaching said implement to said tractor with a three point hitch connection;

c) rotting said disk assembly with said power take-off system;

d) limiting the depth of penetration of said disk assembly and said breaker tooth;

e) towing said implement in a longitudinal direction over a body of soil generally perpendicular to the rows and furrows of a cultivated field thereby forming a drainage ditch: and f) slinging and depositing soil removed from said ditch in a proper manner whereby said soil disposition is controlled and strategically place in close proximity to one side of said disk assembly.

* * * * *